US006688698B1

(12) United States Patent
Chou et al.

(10) Patent No.: US 6,688,698 B1
(45) Date of Patent: Feb. 10, 2004

(54) ADJUSTMENT MECHANISM FOR AN ARMREST OF A CHAIR

(76) Inventors: Ting-Kuo Chou, No. 29-10, Nioujuang Li, Shanhua Jen, Tainan (TW); Kuo-Ching Chou, No. 29-10, Nioujuang Li, Shanhua Jen, Tainan (TW)

( * ) Notice: Subject to any disclaimer, the term of this patent is extended or adjusted under 35 U.S.C. 154(b) by 0 days.

(21) Appl. No.: 10/396,450

(22) Filed: Mar. 26, 2003

(30) Foreign Application Priority Data

Mar. 5, 2003 (TW) ..... 092203310 U

(51) Int. Cl.[7] ..... A47C 7/54
(52) U.S. Cl. ..... 297/411.36
(58) Field of Search ..... 297/344.15, 353, 297/411.36, 411.35

(56) References Cited

U.S. PATENT DOCUMENTS 2,584,732 A * 2/1952 Okun ..... 297/411.25
4,887,866 A * 12/1989 Rusin ..... 297/411.38
5,547,253 A * 8/1996 Schwartz et al. ..... 297/338
6,386,636 B2 * 5/2002 Caruso et al. ..... 297/353
6,523,898 B1 * 2/2003 Ball et al. ..... 297/411.4
D472,080 S * 3/2003 Kita ..... D6/500
2002/0158500 A1 * 10/2002 Chu et al. ..... 297/411.36

* cited by examiner

*Primary Examiner*—Peter R. Brown
(74) *Attorney, Agent, or Firm*—Rosenberg, Klein & Lee

(57) ABSTRACT

A chair is provided with adjustable armrests. The chair has two vertical guiding bars, each of which extends down from a lateral side of a back thereof, and each of which has engaging trenches spaced along it. Each armrest has a connecting space extending vertically through a rear end thereof, and is up and down movably connected to a corresponding guiding bar at the connecting space thereof. A lever is pivoted to a bottom of the rear end of each armrest. Each lever has an engaging projection, which can be fitted into one of the engaging trenches of corresponding guiding bar to make the armrest unmovable by means of pivoting the lever to the locking position. When the levers are in the unlocking position, the armrests can be adjusted in height.

3 Claims, 7 Drawing Sheets

ADJUSTMENT MECHANISM FOR AN ARMREST OF A CHAIR

BACKGROUND OF THE INVENTION

1. Field of the Invention

The present invention relates to an adjustment mechanism for an armrest of a chair, more particularly one, which is used for adjusting the height of an armrest, and is uncomplicated in structure, and easy to operate.

2. Brief Description of the Prior Art

It is an important task of every manufacturer to make constant research and development aimed at making its products more and more convenient and comfortable to use for consumers.

Armrests of chairs are provided for sitters to comfortably rest their arms on, and are preferably adjustable in position to suit all sitters of different heights so as to provide more comfort.

SUMMARY OF THE INVENTION

It is a main object of the present invention to provide a chair having adjustable armrests.

The chair according to the present invention has two vertical guiding bars, each of which extends down from a lateral side of a back thereof, and each of which has engaging trenches spaced along it. Each armrest has a connecting space extending vertically through a rear end thereof, and is up and down movably connected to a corresponding guiding bar at the connecting space thereof. A lever is pivoted to a bottom of the rear end of each armrest, and has an engaging projection, which can be fitted into one of the engaging trenches of corresponding guiding bar to make the armrest unmovable by means of pivoting the lever to the locking position.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
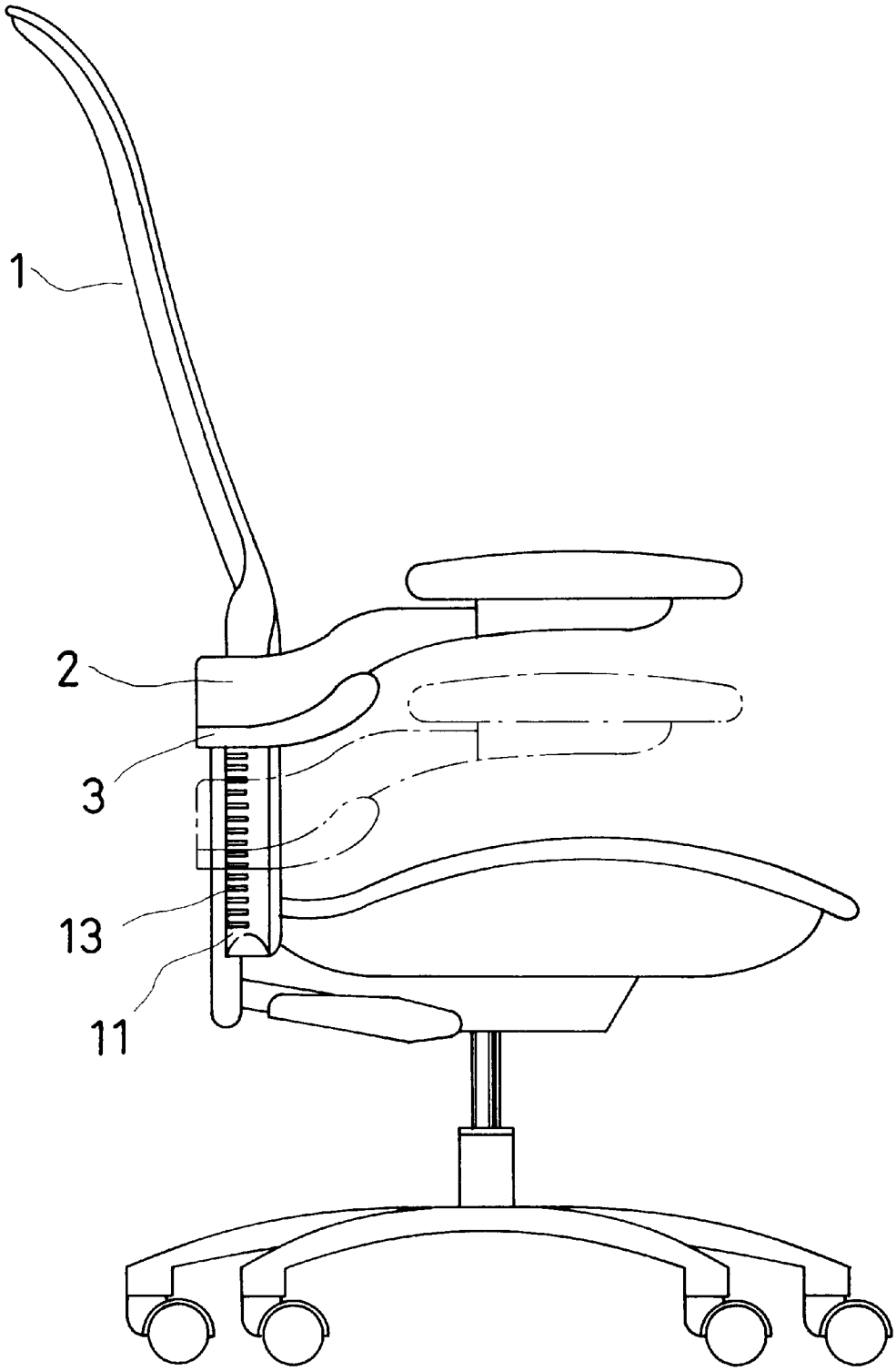
FIG. 1 is a side view of a chair with an adjustment mechanism for an armrest according to the present invention.
Figure 2:
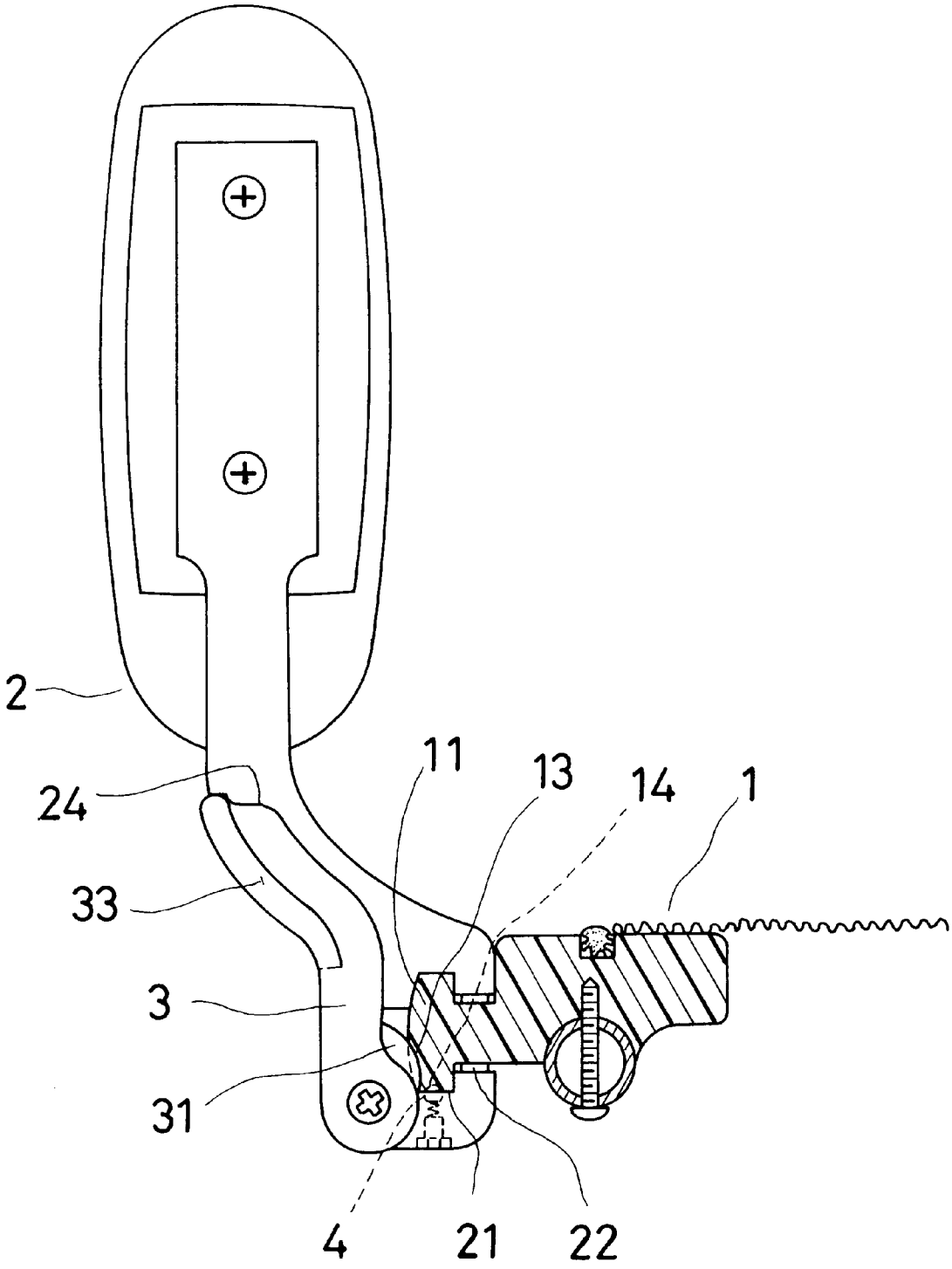
FIG. 2 is a bottom view of the adjustment mechanism for an armrest according to the present invention.
Figure 3:
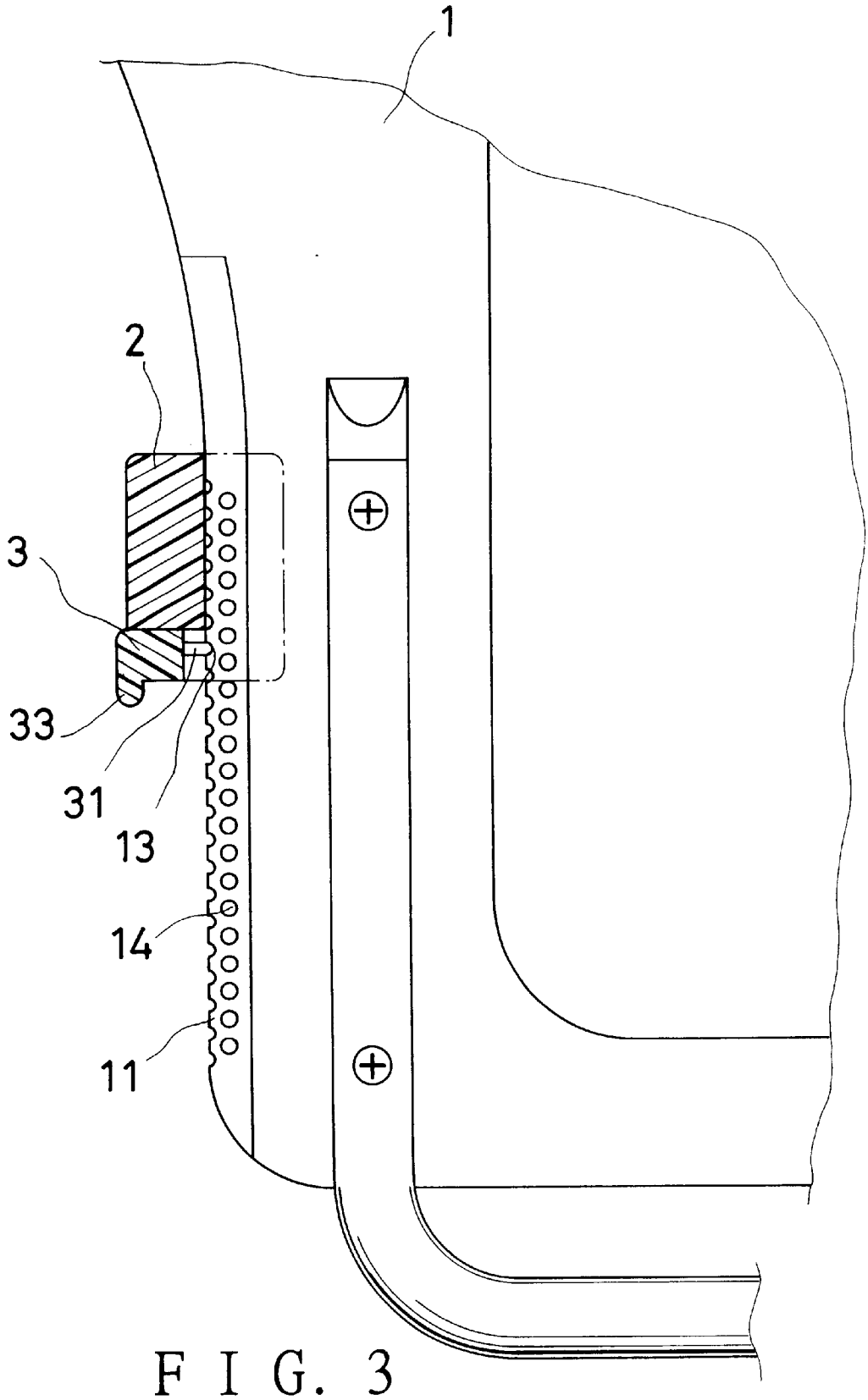
FIG. 3 is a partial rear view of a chair with the adjustment mechanism for an armrest according to the present invention.
Figure 4:
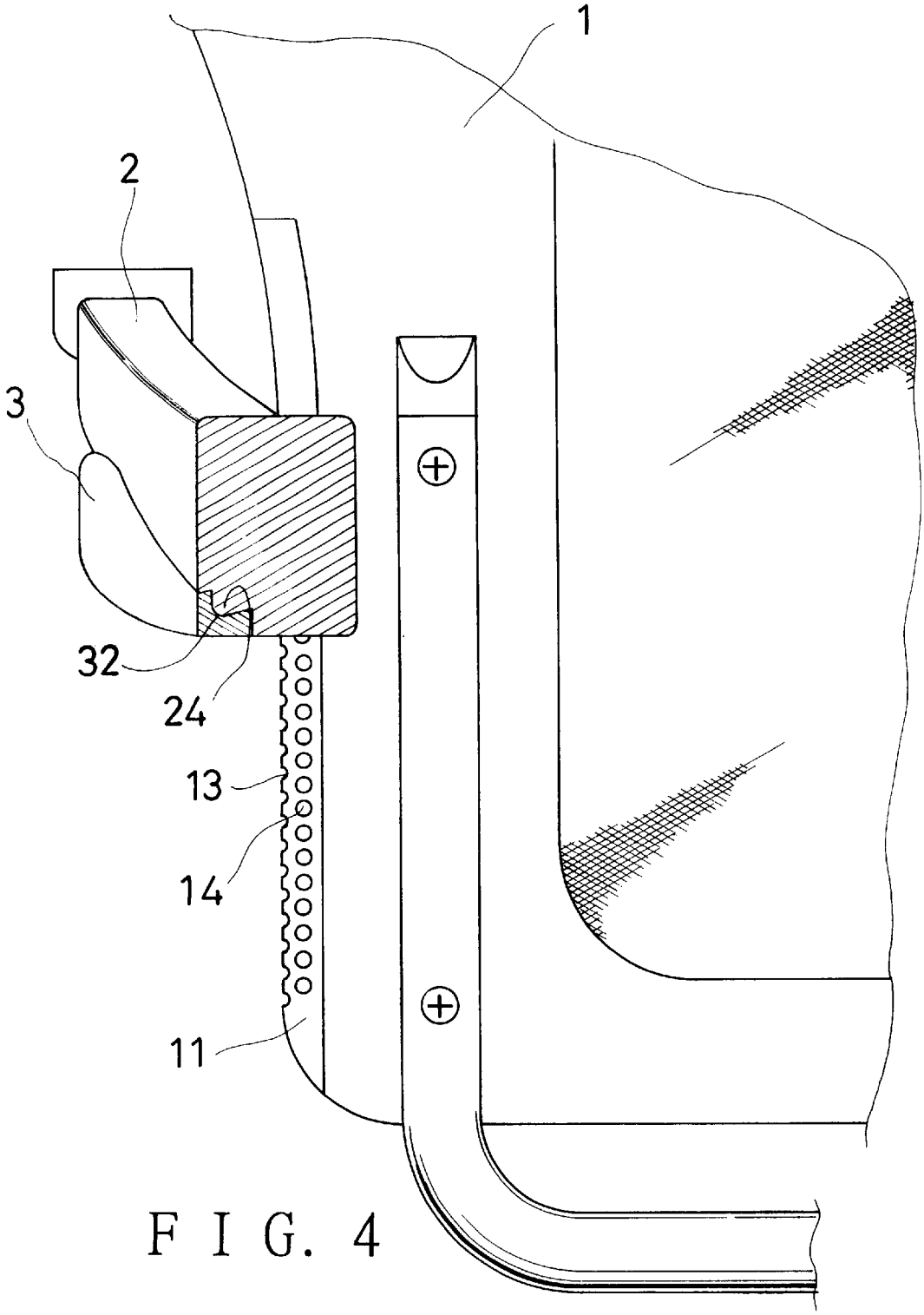
FIG. 4 is a cross-sectional view of the adjustment mechanism of the present invention, in a locking position.
Figure 5:
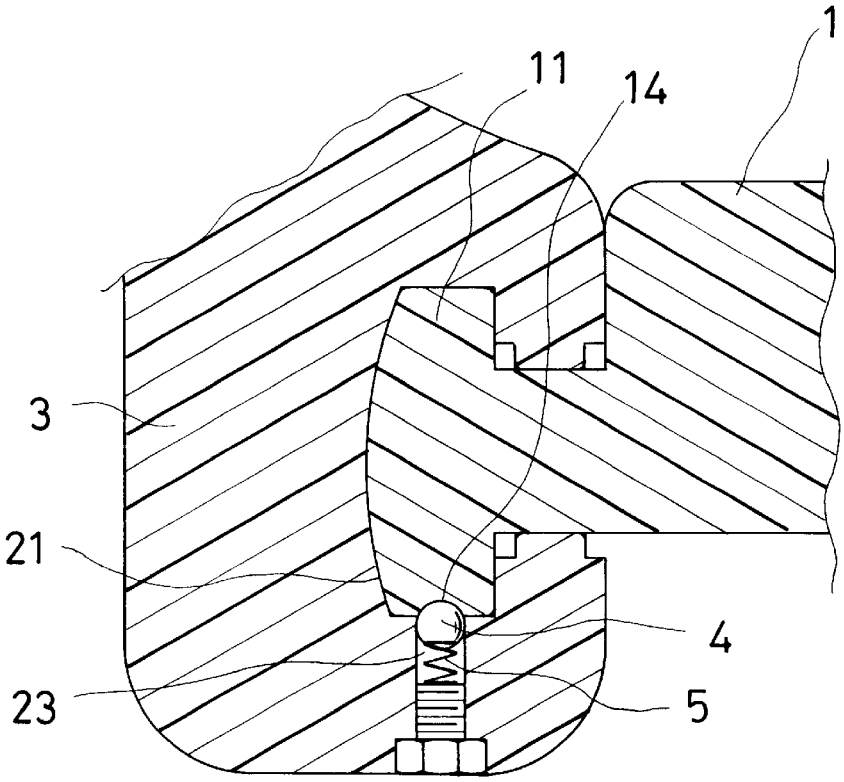
FIG. 5 is a cross-sectional view of the adjustment mechanism of the present invention with the bead being fitted to one of the cavities.
Figure 8:
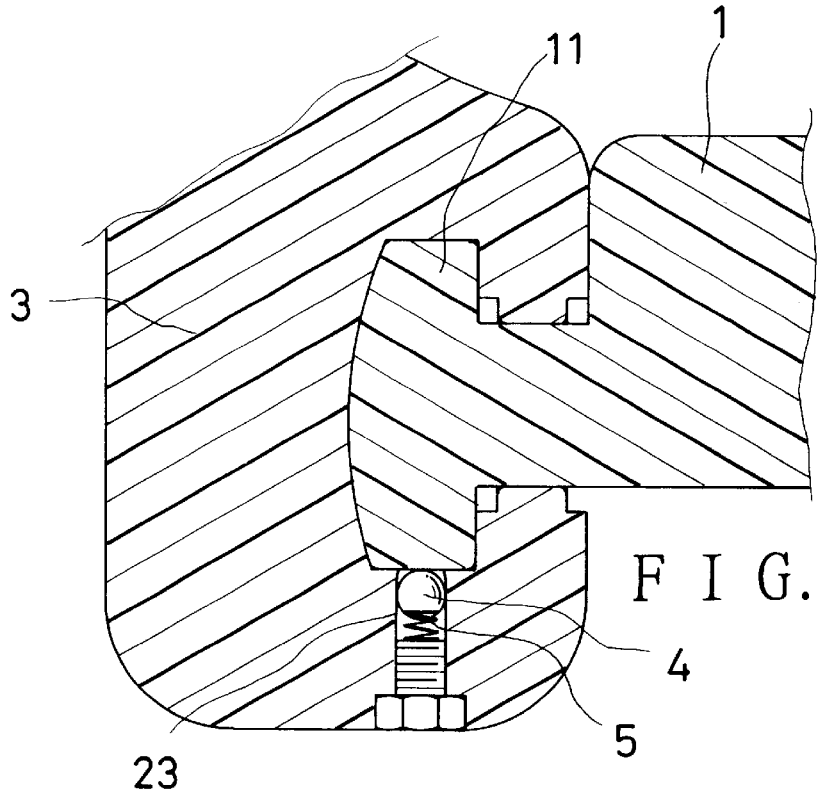
FIG. 8 is a cross-sectional view of the adjustment mechanism of the present invention with the bead being outside the cavities.
Figure 6:
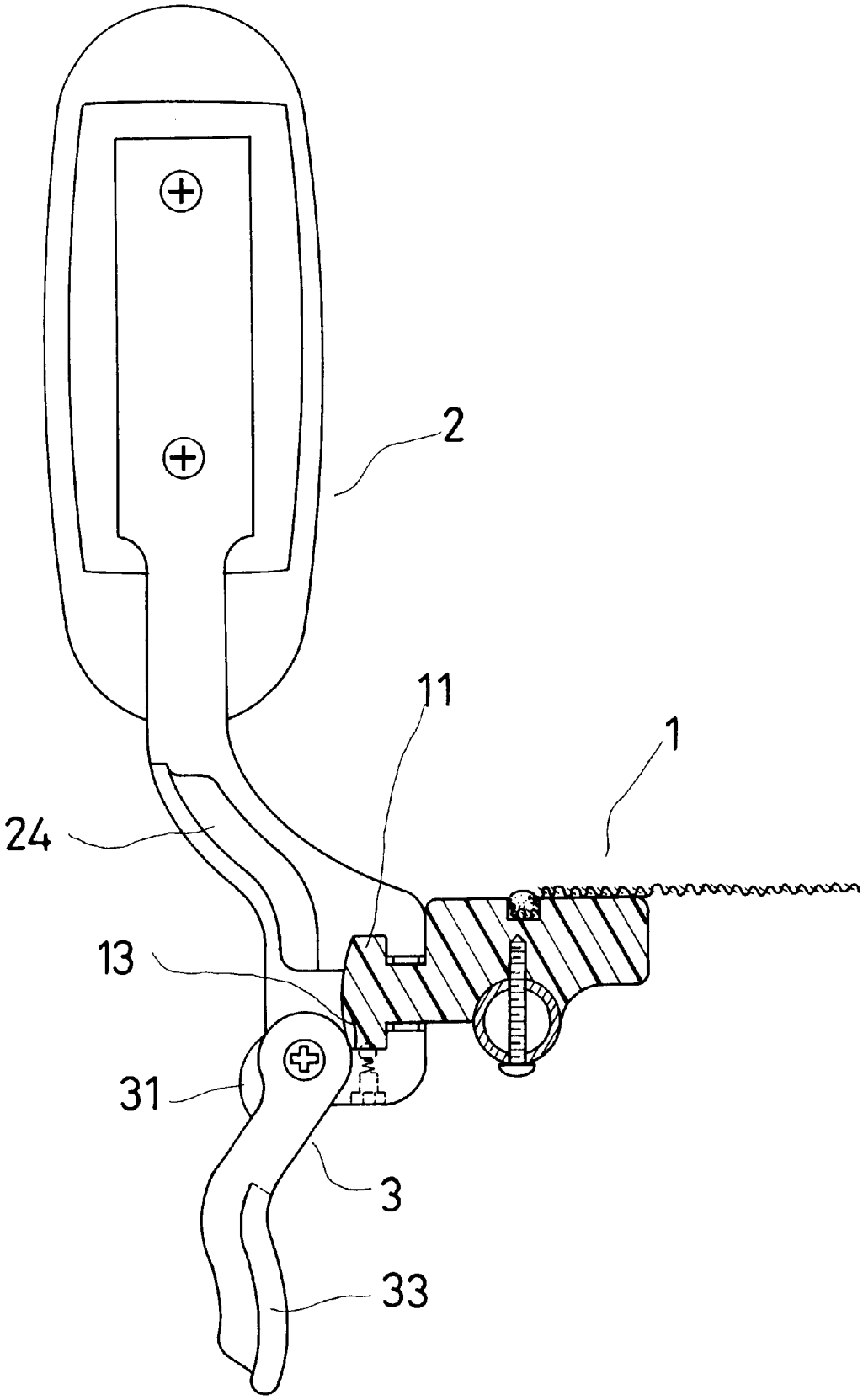
FIG. 6 is a bottom view of the adjustment mechanism of the present invention, in an unlocking position.
Figure 7:
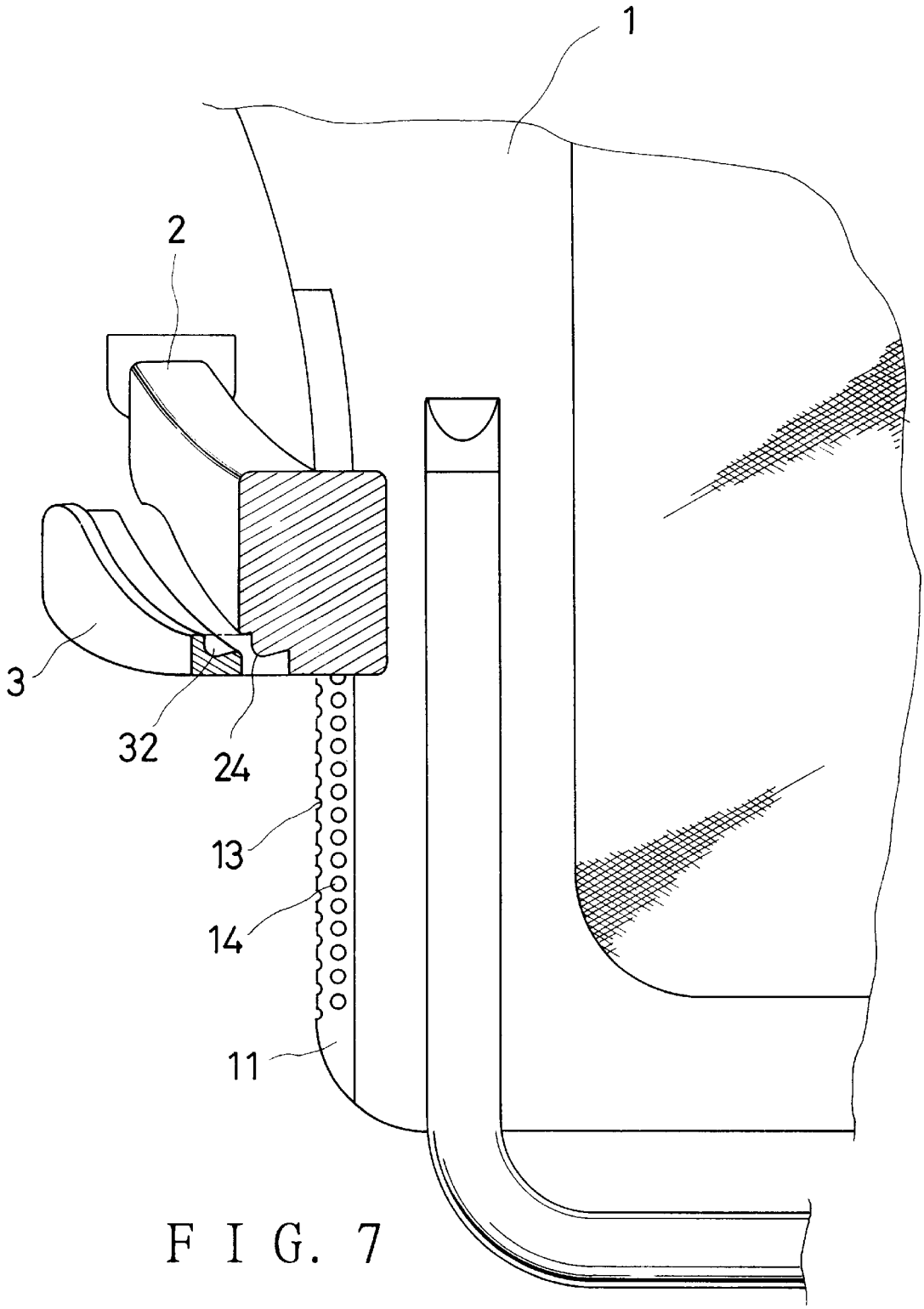
FIG. 7 is a partial rear view of the adjustment mechanism of the present invention, in an unlocking position.

Referring to FIGS. 1 to 5, a preferred embodiment of an adjustment mechanism for an armrest of a chair in the present invention includes:

a substantially vertical guiding bar 11 extending down from a lateral side of a back 1 of a chair for connection with an armrest; the guiding bar 11 has an outer portion, and an inner portion 12 narrower than the outer portion, engaging trenches 13 extending transversely and spaced along a first side, and engaging cavities 14 spaced along a second side and corresponding to respective engaging trenches 13;

a through hole 21 vertically extending through a rear end of an armrest 2 for holding the outer portion of the guiding bar 11, a vertically extending opening 22 formed on the armrest 2 and adjacent to the though hole 21, and a holding hole 23 formed on the rear end of the armrest 2, communicating with the through hole 21 as well as facing the second side of the guiding bar 11; the opening 22 is shaped such that the inner portion 12 of the guiding bar 11 can be movably fitted in; the armrest 2 further has a locating protrusion 24 on an outward side thereof; and a lever 3 pivoted to a bottom side of the rear end of the armrest 2; the lever 3 includes an engaging projection 31, a locating recess 32, and an extension portion 33, on which a user is to exert force with his fingers in moving the lever 3; the engaging projection 31 is formed near where the lever 3 is pivoted to the armrest 2 so that it can contact the first side of the guiding bar 11 when the lever 3 is in a locking position; the locating recess 32 is formed on an upper side of the lever 3 for fitting over the locating protrusion 24 of the armrest 2 when the lever 3 is in the locking position.

In assembling the chair, the handle 2 is slid onto the guiding bar 11 from the through hole 21 and the opening 22 thereof so that the first side of the bar 11, on which the engaging trenches 13 are formed, face outwards, and the second side of the bar 11, on which the engaging cavities 14 are formed, face the holding hole 23. And, a bead 4 and an elastic element 5 are inserted into the holding hole 23 in sequence, and a securing element (not numbered) is joined to the hole 23 for preventing the bead 4 and the elastic element 5 from falling out; thus, the elastic element 5 biases the bead 4 towards the through hole 21 to contact the second side of the guiding bar 11.

When the lever 3 is pivoted outwards and away from the locating protrusion 24 of the armrest 2, the engaging projection 31 is disengaged from the trenches 13 of the guiding bar 11, and in turns, the armrest 2 can be moved up and down along the bar 11 for adjustment of height. In adjusting the armrest 2, the bead 4 will slide on the second side of the bar 11, engaging and disengaging the engaging cavities 14 in an alternate way as the armrest 2 is being moved.

The engaging projection 31 is located so that it can engage one of the trenches 13 when the bead 4 is as high as one of the cavities 14, a person adjusting the armrest 2 should stop moving the armrest 2 as soon as he hears the bead 4 snapping onto the cavities 14 after moving the armrest 2 close to an appropriate position; thus, the lever 3 can be easily pivoted to the locking position with the engaging projection 31 engaging one of the trenches 13, and with the locating recess 32 fitting over the locating protrusion 24.

From the above description, it can be easily understood that the adjustment mechanism for an armrest of a chair in the present invention has advantages as followings:

1. The adjustment mechanism is provided to an armrest of each side of a chair, and only consists of a guiding bar, and a lever besides the armrest, being relatively simple in structure.
2. The armrest is made adjustable with the lever, and the lever can be easily moved between the locking and the unlocking positions therefore the adjustment mechanism is easy to operate.

3. The bead can snap onto the cavities to produce sound to notice the user when the armrest is moved to such a position that the engaging projection of the lever is allowed to fit into the trenches therefore the adjustment mechanism is convenient to use.

What is claimed is:

1. An adjustment mechanism for an armrest of a chair, comprising:

a substantially vertical guiding bar extending down from a lateral side of a back of a chair; the guiding bar having a plurality of engaging trenches spaced along a first side thereof;

a through hole extending substantially vertically through a rear end of an armrest, and an opening formed along the armrest and in communication with the through hole, the armrest being up and down movably connected to the guiding bar at the through hole and the opening thereof, the guiding bar having an outer portion, and an inner portion narrower than the outer portion, which are fitted to the through hole, and the opening of the rear end of the armrest respectively; and a lever pivoted to a bottom side of the rear end of the armrest, the lever having an engaging projection, the engaging projection being capable of engaging one of the engaging trenches of the guiding bar to fix the armrest in position when the lever is pivoted to a locking position.

2. An adjustment mechanism for an armrest of a chair, comprising:

a substantially vertical guiding bar extending down from a lateral side of a back of a chair; the guiding bar having a plurality of engaging trenches spaced along a first side thereof, the guiding bar having engaging cavities spaced along a second side thereof to correspond to respective engaging trenches of the first side thereof, and a bead is biased to contact the second side with a spring, and being movable up and down together with the armrest;

a through hole extending substantially vertically through a rear end of an armrest, and an opening formed along the armrest and in communication with the through hole, the armrest being up and down movably connected to the guiding bar at the through hole and the opening thereof; and a lever pivoted to a bottom side of the rear end of the armrest, the lever having an engaging projection, the engaging projection being capable of engaging one of the engaging trenches of the guiding bar to fix the armrest in position when the lever is pivoted to a locking position, the engaging projection being allowed to be fitted into the engaging trenches when the bead is fitted onto the engaging cavities.

3. An adjustment mechanism for an armrest of a chair, comprising:

a substantially vertical guiding bar extending down from a lateral side of a back of a chair; the guiding bar having a plurality of engaging trenches spaced along a first side thereof;

a through hole extending substantially vertically through a rear end of an armrest, and an opening formed along the armrest and in communication with the through hole, the armrest being up and down movably connected to the guiding bar at the through hole and the opening thereof;

a lever pivoted to a bottom side of the rear end of the armrest, the lever having an engaging projection, the engaging projection being capable of engaging one of the engaging trenches of the guiding bar to fix the armrest in position when the lever is pivoted to a locking position; and a locating protrusion on an outward side of the armrest, the lever having a locating recess on an upper side thereof for fitting over the locating protrusion of the armrest when the lever is in the locking position.

* * * * *